US009815528B2

(12) United States Patent
Baugh

(10) Patent No.: US 9,815,528 B2
(45) Date of Patent: Nov. 14, 2017

(54) METHOD OF LOWERING SUBSEA PACKAGES

(71) Applicant: Reel Power Licensing Corp., Oklahoma City, OK (US)

(72) Inventor: Benton Frederick Baugh, Houston, TX (US)

(73) Assignee: Reel Power Licensing Corp., Oklahoma City, OK (US)

( * ) Notice: Subject to any disclaimer, the term of this patent is extended or adjusted under 35 U.S.C. 154(b) by 497 days.

(21) Appl. No.: 14/515,487

(22) Filed: Oct. 30, 2014

(65) Prior Publication Data

US 2016/0121974 A1 May 5, 2016

(51) Int. Cl.

*B63B 27/08* (2006.01)
*B63B 27/10* (2006.01)
*B63B 27/16* (2006.01)

(52) U.S. Cl.

CPC ..... *B63B 27/08* (2013.01); *B63B 27/10* (2013.01); *B63B 2027/165* (2013.01)

(58) Field of Classification Search

CPC ... B63B 27/08; B63B 27/10; B63B 2027/165; B65G 67/60; B65G 67/603; B66D 1/36; B66D 1/40; B66D 1/772; B66D 3/003; B66D 3/26

See application file for complete search history.

(56) References Cited

U.S. PATENT DOCUMENTS 2,792,930 A * 5/1957 Graham ..... B63B 35/04 226/172
3,150,397 A * 9/1964 Caperton ..... E03F 9/005 15/104.33
3,399,416 A * 9/1968 Caperton ..... B65H 51/14 15/104.33
4,090,675 A * 5/1978 Betta ..... B65H 51/06 242/366.2
4,265,304 A 5/1981 Baugh
5,950,953 A 9/1999 Baugh
6,443,383 B1 * 9/2002 Stasny ..... B63G 8/42 242/388
6,820,705 B2 11/2004 Baugh

* cited by examiner

*Primary Examiner* — Emmanuel M Marcelo
(74) *Attorney, Agent, or Firm* — Phillips Murrah PC; Marting G. Ozinga

(57) ABSTRACT

The method of supporting and lowering a subsea package load on an umbilical from the deck of an offshore service vessel to a subsea work location including providing a reel to store the umbilical on the deck which is not capable of sustaining the maximum load, providing a supporting tractor with dual chains which have multiple dogs mounted on skewed surfaces which amplify a spring load support against the umbilical for frictional support of the umbilical and therefore the subsea package.

12 Claims, 7 Drawing Sheets

METHOD OF LOWERING SUBSEA PACKAGES

TECHNICAL FIELD

This invention relates to the method of lowering and raising payloads into ocean depths using a winch system.

BACKGROUND OF THE INVENTION

Conventional lowering and lifting in subsea environments using an armored umbilical (lowering/communication cable) is by using a winch with the load rating suitable to the task. When lowering a load to extreme depth such as 10,000 feet, the weight of the armored umbilical in water will often exceed the weight of the payload. In the case of a remotely operated vehicle (ROV), the objective is to make the ROV as near neutrally buoyant for ease of operations with only enough weight to allow it to be lowered to the desired depth. The net weight of the ROV plus a handling cage or top hat will be in the range of 1000 lbs., and the armored umbilical getting it to the bottom can exceed 20,000 lbs. Some ROVs are lowered subsea in a heavy cage and swim out as a neutrally buoyant assembly on a short flexible lead. Some ROVs are lowered below a heavy top hat and are released when at the working depth with a short umbilical from a small reel mounted in the top hat.

The armored cable must have substantial capacity as the ROV plus cage or top hat will weigh 1000 lbs. in water, but may well weigh 30,000 lbs. when being lifted through the air/water interface and onto the deck. The winch system at the surface sees its maximum load condition either when it is being lifted through the air/water interface or when it is at its lowest operational depth. Although the ROV plus Top Hat will be only a smaller load such as 1000 lbs., the steel armored umbilical when fully deployed will represent a major load.

With the requirement for 10,000 feet or more in armored cable under tensions up to 30,000 lbs., the crushing load on the drum and the loading on the end flanges which acts similar to pressure, requiring the winch spool to be relatively heavy and expensive to manufacture. The winch torsional requirements for lifting the ROV system out of the water at the air/water interface mandate a substantial gear box to be provided.

An additional difficulty with the conventional winch arrangement is that the cable must be loaded onto the spool with tensions in the range of 12,000 lbs., or when a 30,000 lb. tension load is imparted the current outer wrap of the umbilical will "knife" into the inner wraps and damage in the cable. In some cases the clients insist that the pre-wrapping is at the full 30,000 lbs. tension for added safety. In addition to general difficulties, when a cable is to be replaced, it means it must be taken to shore to be reloaded with equipment which can hold a back tension of 12,000 lbs. (or 30,000 lbs.) tension as it is being spooled.

Some loads similar to this have been handled by coiled tubing injector heads such as the Beta Coiled Tubing Units manufactured by the Beta Division of Brown Oil Tools in the 1970 time frame (U.S. Pat. No. 4,265,304) and is contemporarily done with traction winches on offshore pipe laying vessels. Characteristically, the friction loading against the cable, coiled tubing, or pipeline is from two opposite directions, tending to squash the cable, coiled tubing, or pipeline to an out of round condition which tends to reduce the service life of the components.

Coiled tubing units have sought to engage the coiled tubing from two sides since the 1960s with the resulting loss in service life of the armored umbilical, coiled tubing, and pipeline. This has not been a detriment to pipe line installation as they are installed one time and left in place. However, coiled tubing and armored umbilicals are characteristically service tools deployed and retrieved repeatedly and the added stress of being deformed reduces their usable service life.

BRIEF SUMMARY OF THE INVENTION

The object of this invention is to provide a method of lowering a subsea package system through the air/water interface and down to a working depth without requiring a winch drum which will sustain the loads inherent in the tension associated with the operations.

A second objective of the present invention is to have the gripping forces on the umbilical to be failsafe due to the mechanical storage of energy rather than depending on hydraulic force to generate the load.

A third object of this invention is to amplify the normal force provided by the failsafe mechanical loading such that the normal force against the umbilical or cable will exceed the normal force provided by the failsafe mechanical loading to a sufficient amount to allow the usage of smooth faced slip inserts rather than slip inserts with sharp teeth which will damage the umbilical.

A fourth objective of this invention is to provide a method of gripping the umbilical in a way which does not tend to squash it to an out of round condition and potentially damage the internal communication links.

Another objective of this invention is to provide a system which allow umbilical to be reinstalled in the field without the need for back tension as it is being installed.

Another objective of this invention is to eliminate the need of a high load sheave to change the direction of the umbilical from vertical to proximately horizontal.

DETAILED DESCRIPTION OF THE INVENTION

Figure 1:
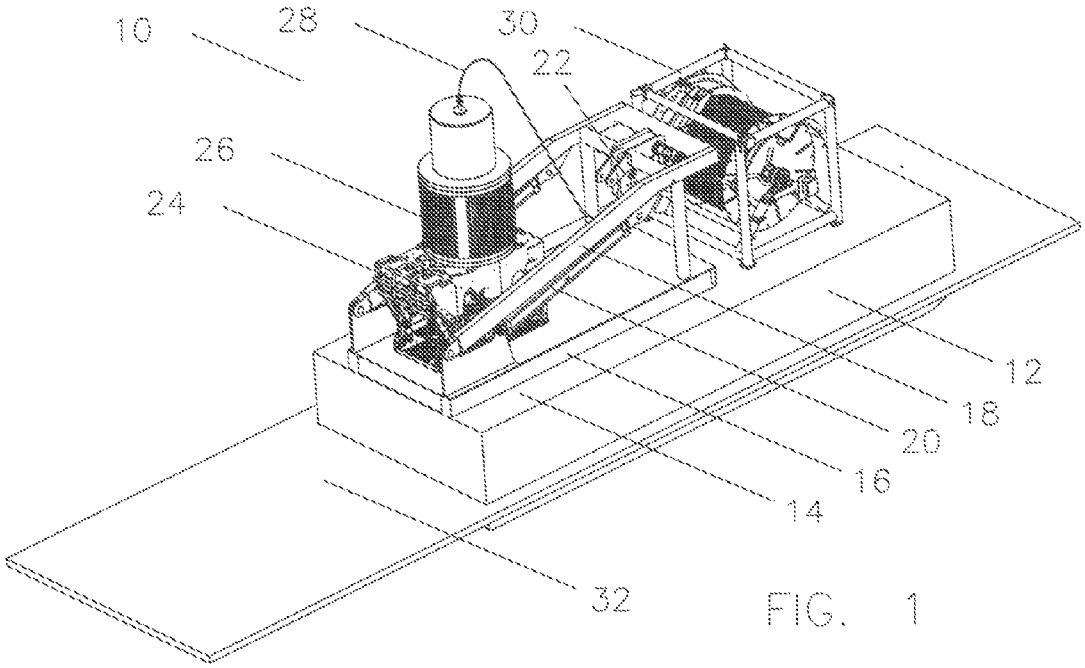
FIG. 1 is a perspective view of an ROV Launch and Recovery System (LARS) as an example of a handling system for a subsea package.

Referring now to FIG. 1, a launch and recovery system (LARS) 10 is shown on an offshore vessel 12 in a laid down mode for travelling. The mast 14 comprises a base 16, a boom 18, lifting cylinders 20, and a tractor 22. A remotely operated vehicle (ROV) 24 is shown with the top hat 26 landed on the top of it. Umbilical 28 is shown coming from the top of the top hat 26, going through the tractor 22, and to a reel 30.

The top hat 26 is a heavy member which will assist the near neutrally buoyant ROV 24 in being lowered to ocean 32 and includes a small reel with a short neutrally buoyant umbilical inside which will allow the ROV 24 to swim away from the top hat 26 to do subsea service operations.

Reel 30 is not a heavy duty winch as is normally associated with LARS systems, but is rather a light duty reel similar to the one as described in U.S. Pat. No. 5,959,953. The distinction between a winch and a reel in this context is that for a reel the load is carried by something else and the reel simply rolls the cable up. In the case of the reel as seen in U.S. Pat. No. 5,950,953, the umbilical is strapped to the blowout preventer drilling riser which carries its weight. As the blowout preventer drilling riser is pulled back to the surface, the reel simply rolls the umbilical up for storage. In contrast, a winch is intended to pick up a load.

Figure 2:
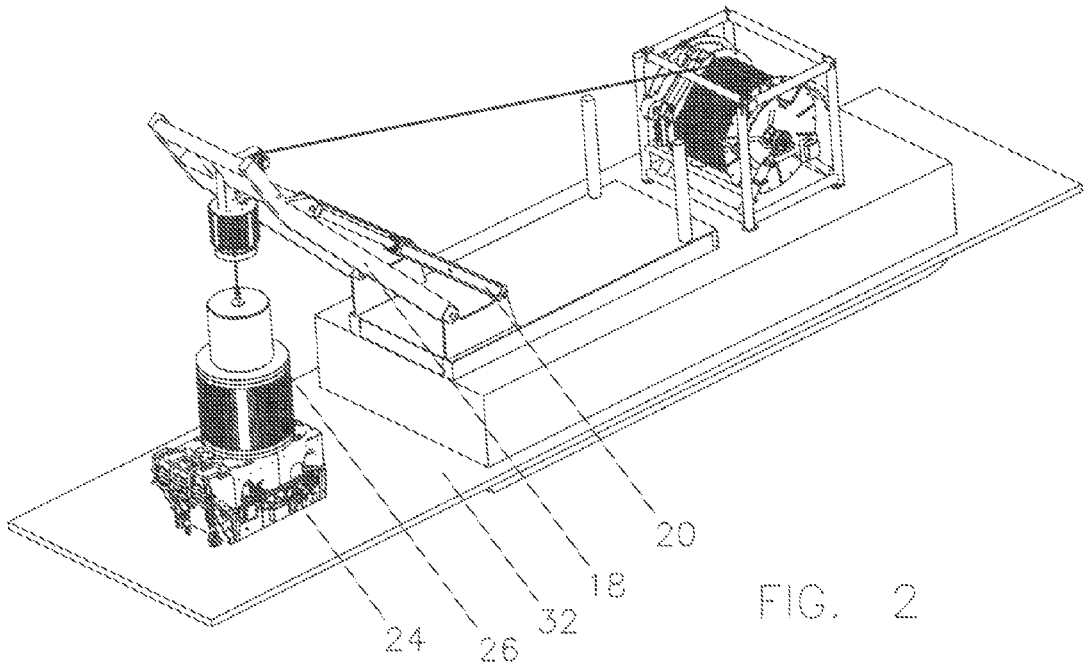
FIG. 2 is a perspective view similar to FIG. 1, except the mast boom is raised to the ROV deploying position.

Referring now to FIG. 2, the same equipment is seen as was seen in FIG. 1 except the lifting cylinders 20 have been stroked out and the boom 18 has lifted the ROV 24 and top hat 26 overboard and is lowering them into the ocean 32 or is recovering them from the ocean 32.

Figure 3:
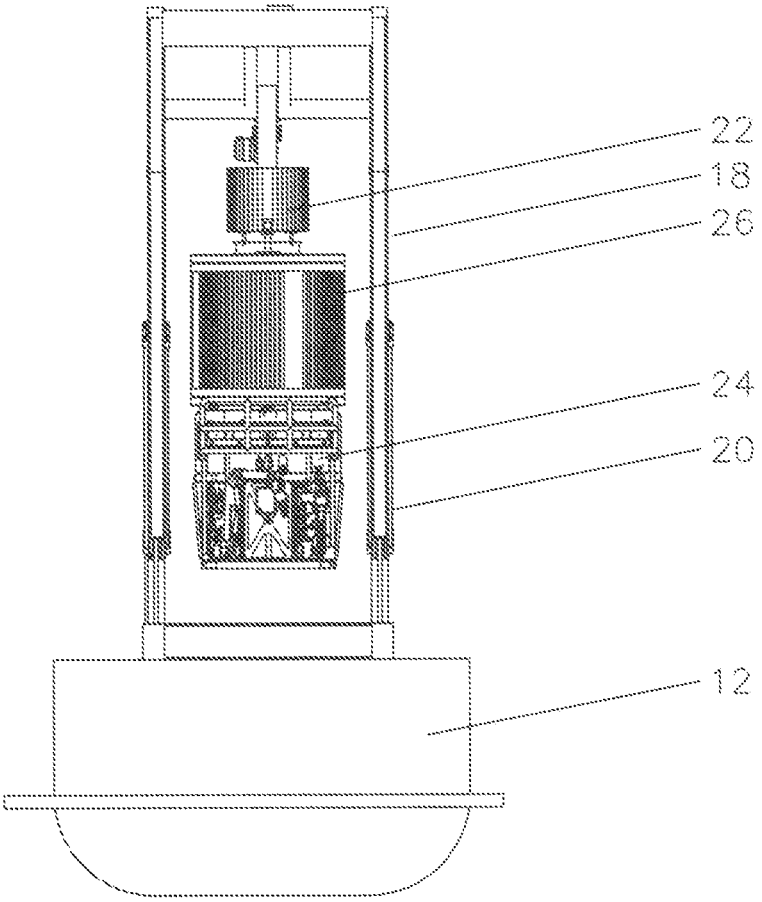
FIG. 3 is a view of the LARS as would be seen from the ocean.

Referring now to FIG. 3, it can be seen that the boom 18 needs to be wide enough to pass the tractor 22, ROV 24, and the top hat 26 as the components are deployed and recovered. As the conditions are relatively tight and the ROV can come up in any orientation, the tractor 22 must be able to rotate the ROV to a desired orientation before the boom 18 can be raised to recover the ROV. Within the tractor 22 there are rotational motors (see FIG. 4) to accomplish this.

Figure 4:
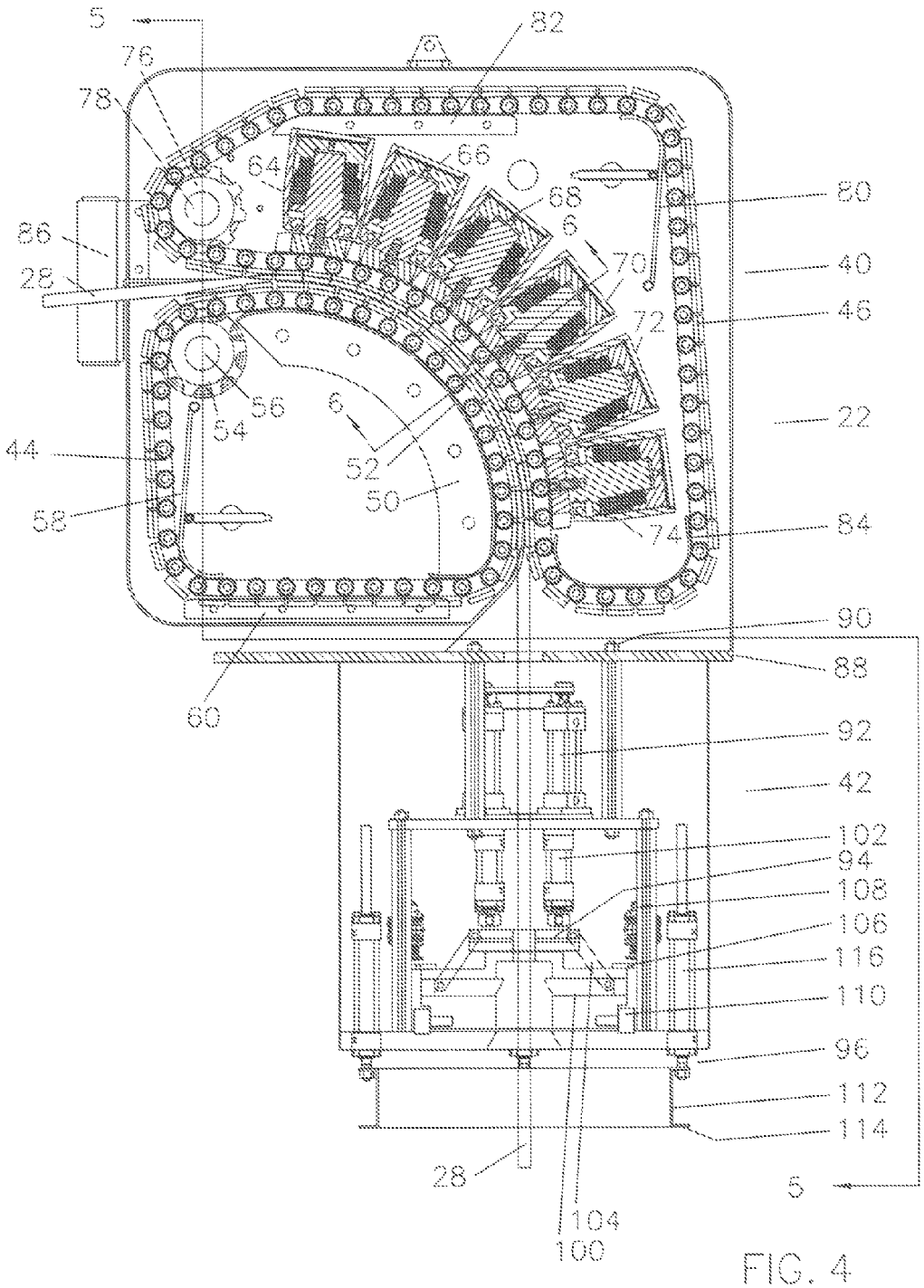
FIG. 4 is a half section of the tractor which embodies this invention.

Referring now to FIG. 4, tractor 22 is shown with pulling section 40 and latch and rotate section 42. Pulling section 40 has an inner chain 44 and an outer chain 46 to grip the umbilical 28. Inner chain 44 has track support 50, hardened track race 52, drive sprocket 54, motor 56, chain tension adjuster 58, and chain support 60. Outer chain 46 has load cylinders 64-74, drive sprocket 76, motor 78, chain tensioner 80, upper chain guide 82, and lower chain guide 84. Load cylinders 64-74 put a failsafe mechanical spring load on the umbilical 28 for friction gripping, as will be seen in FIGS. 6 and 7. Umbilical 28 enters the tractor 22 on the upper left side and naturally has considerable vertical flexibility. Rollers 86 are added on each side of the umbilical 28 to guide the umbilical horizontally to make sure it aligns with the inner and outer chains 44 and 46. Pulling section 40 has a bottom plate 88 which the latch and rotate section 42 is attached with bolts 90.

Latch and rotate section 42 includes slip assembly 92, latch assembly 94, and cushion assembly 96. Slip assembly 92 has internal smooth faced dogs (not shown) to provide failsafe support for the umbilical without scratching it as is illustrated in U.S. Pat. No. 6,820,705.

Latch assembly 94 provides dogs 100 to engage a profile on the top of the top hat 26 for support of the top hat 26 and the ROV 24 when parked at the surface. Dogs 100 are operated by cylinders 102 and linkages 104. Latch assembly 94 also includes a large gear 106, motor 108, and bearings 110 to rotate the top hat 26 and ROV 24 to the proper orientation for landing on the vessel as seen in FIG. 3.

Cushion assembly 96 includes a ring 112 with a lower surface 114 for contacting the upper surface of the top hat 26, and dampening means 116 to slow the upward movement of the top hat 26 and the ROV 24 they approach the upper end of their travel to prevent damage.

Figure 5:
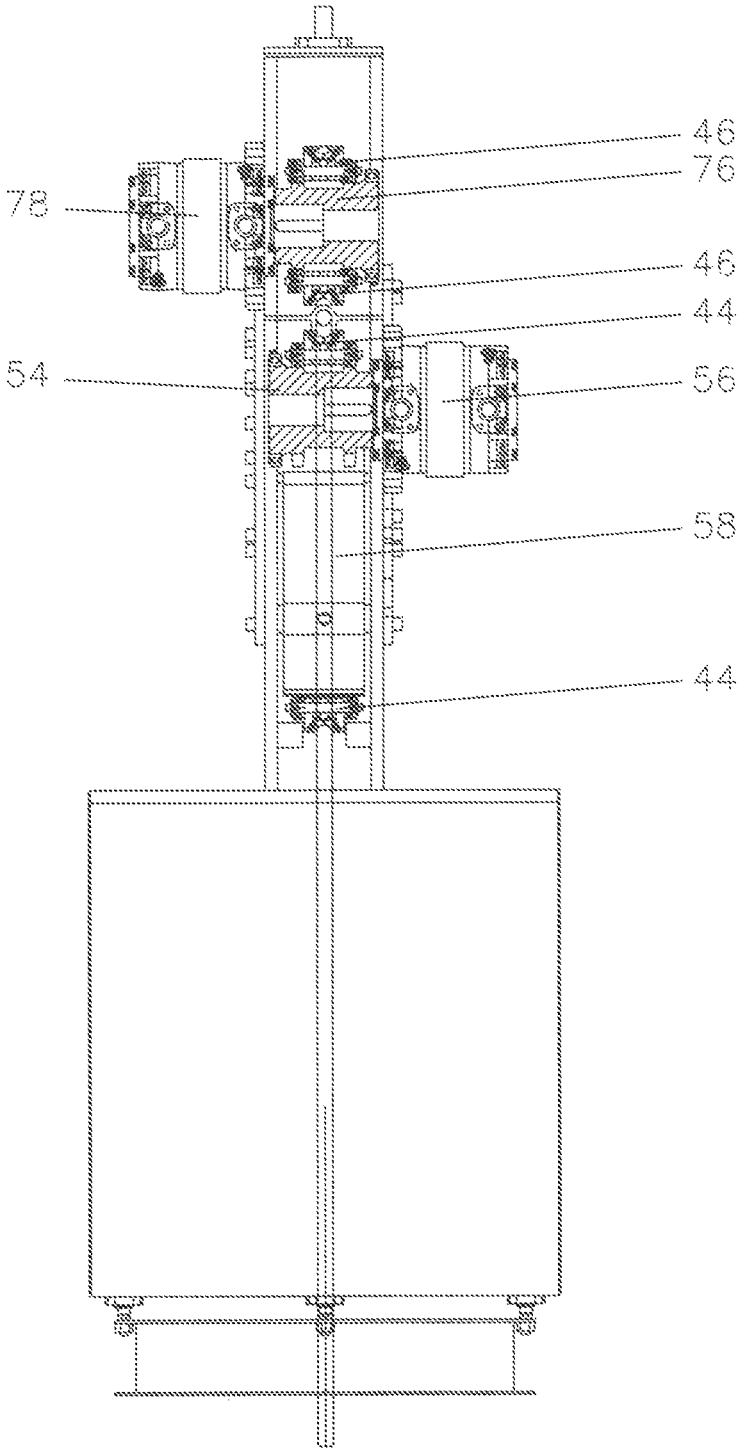
FIG. 5 is a partial section of FIG. 4 taken along lines "5-5".

Referring now to FIG. 5, a partial section of the tractor 22 taken along lines "5-5" showing the inner chain 44, the outer chain 46, sprockets 54 and 76, and motors 56 and 78.

Figure 6:
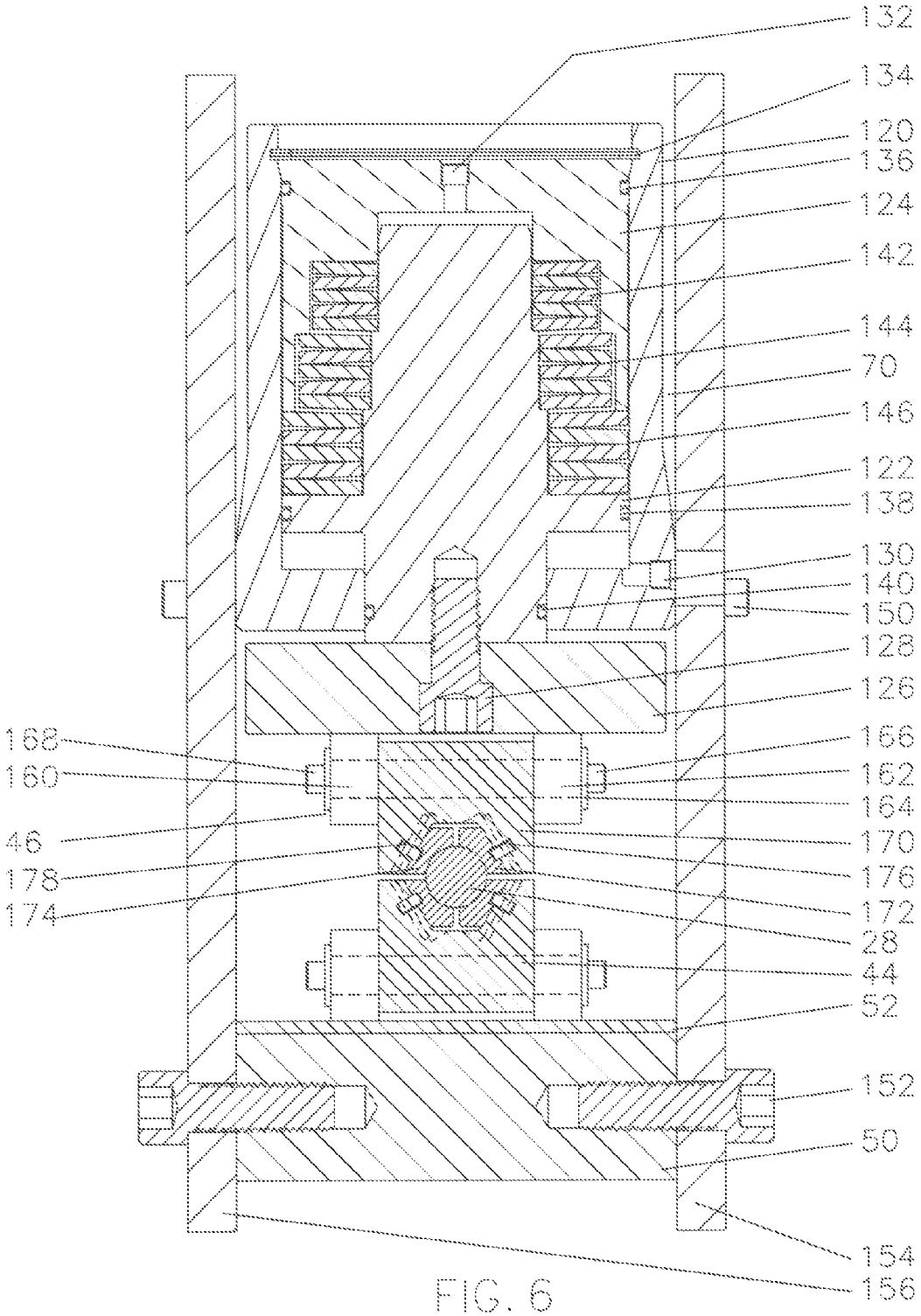
FIG. 6 is a partial section of FIG. 4 taken along lines "6-6".

Referring now to FIG. 6, a partial section of tractor 22 taken along lines "6-6" of FIG. 4 is shown. Load cylinder 70 provides cylinder 120, piston 122, cap 124, load shoe 126, bolt 128, retract port 130, load port 132, retaining ring 134, seals 136-140, upper spring washers 142, middle spring washers 144, and lower spring washers 146. Bolts 150 and 152 connect load cylinder 70 and support track 50 to side plates 154 and 156 respectively. Outer chain 46 is shown with rollers 160 and 162 connected to axle 164 (not shown) by bolts 186 and 168, chain block 170, chain dogs 172 and 174, and leaf springs 176 and 178. Inner chain 44 is made of similar components.

Figure 7:
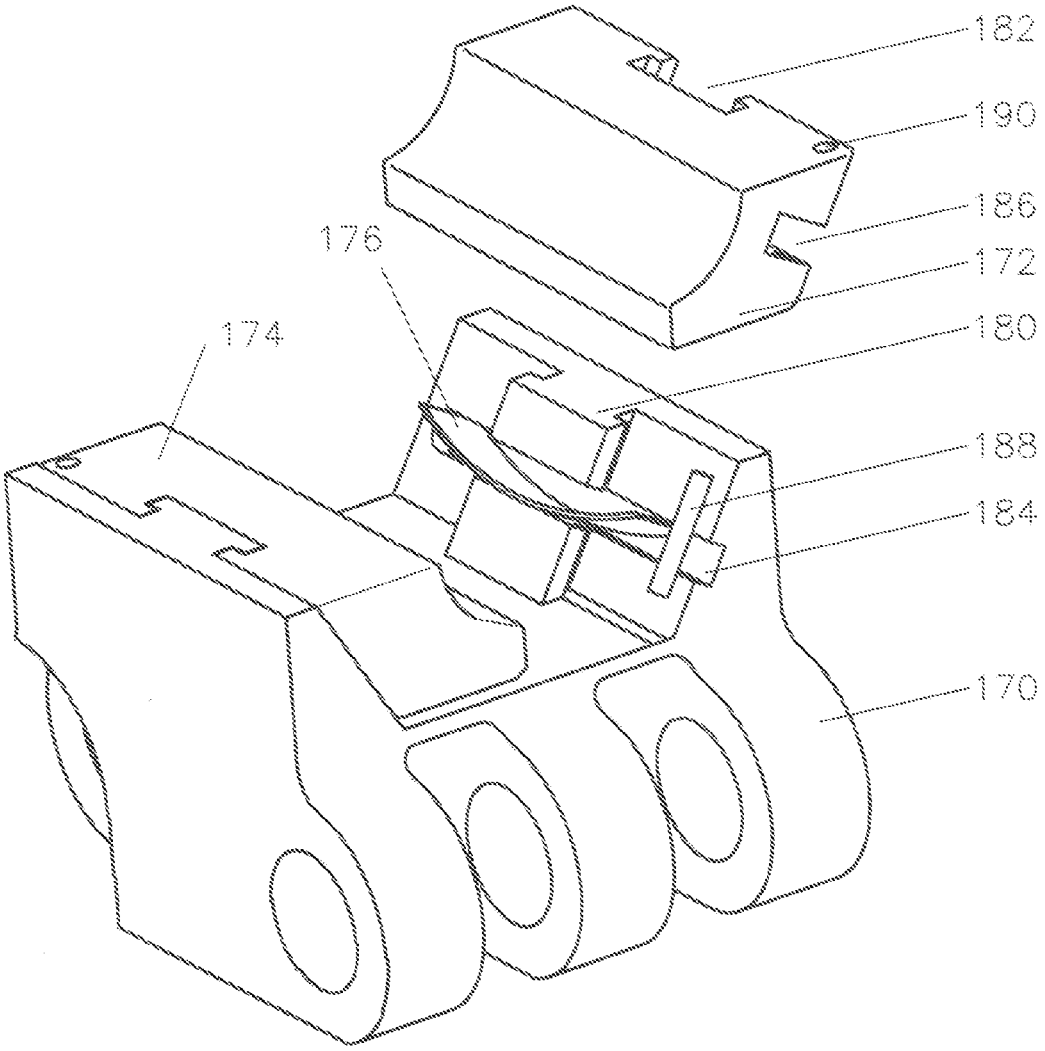
FIG. 7 is a perspective view of a section of chain with a chain dog separated from the chain block.

Referring now to FIG. 7, a perspective view of chain block 170 is shown with chain dog 172 displaced upwardly for clarity. T-slot profiles 180 on chain block 170 and 182 on chain dog 172 are prepared to allow movement in one direction along the t-slots 180 and 182, but not along the direction of the chain itself. Leaf spring 176 holds chain dog 172 in a desired initial position, but allows it to be moved along the direction of the t-slots 180 and 182 for purposes to be discussed. After the chain dog 172 is assembled on the chain block 170 similarly to how chain dog 174 is shown, the leaf spring 176 is inserted into the end of the then aligned slots 184 and 188 and spring pin 188 is inserted into hole 190. In this way spring pin 188 retains the leaf spring 178, and the leaf spring 176 retains the chain dog 172. A similar leaf spring 178 and roll pin are inserted in the opposite end of chain dog 174.

Figure 8:
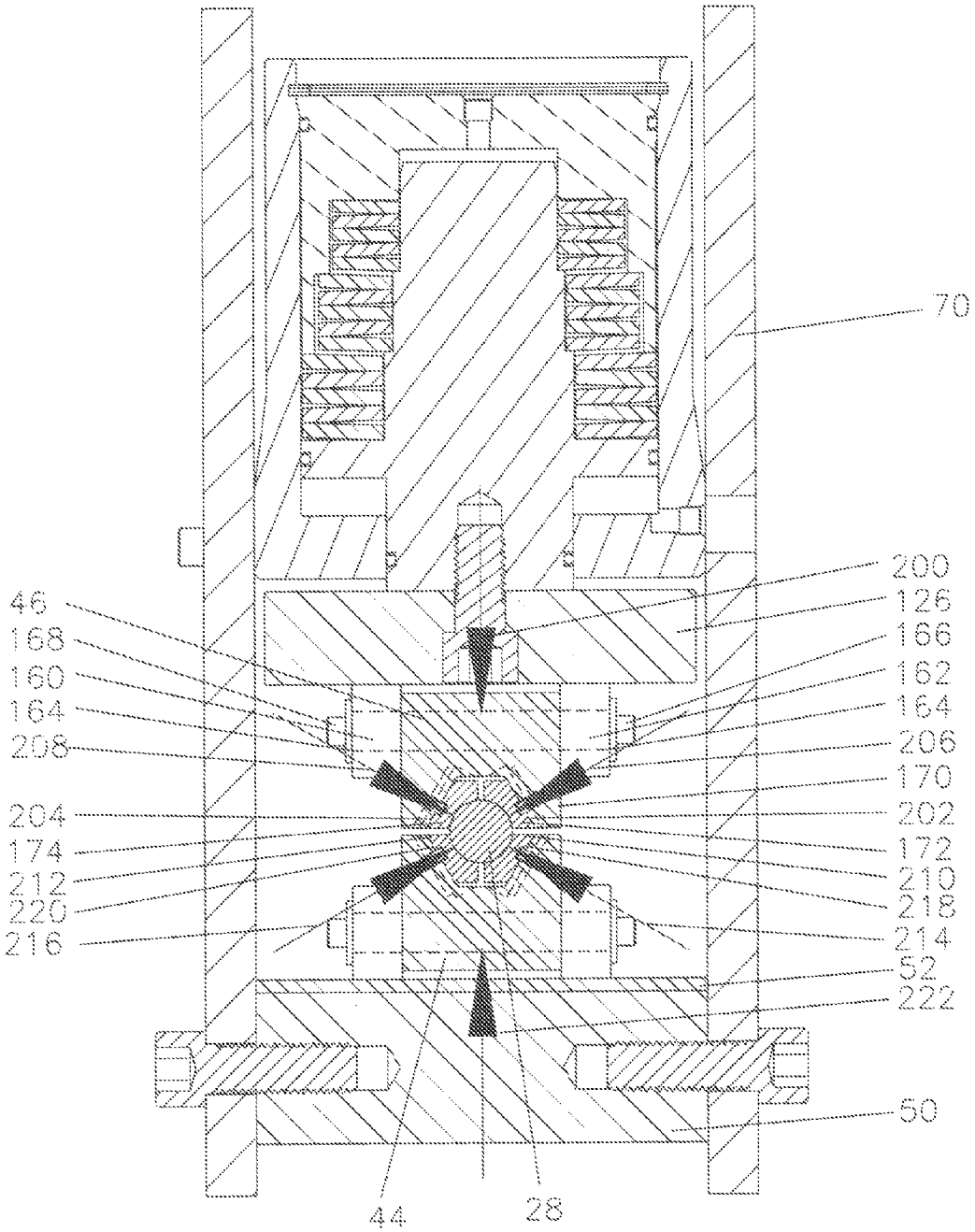
FIG. 8 is the same view as FIG. 6 showing the forces vectors and amplification of the forces.

Referring now to FIG. 8, the same partial section of FIG. 6 is seen again with force vector arrows illustrated. Load cylinder 70 provides a force 200 on load shoe 126 which is imparted to rollers 160 and 162 and then to chain block 170. The force 200 against chain block 170 of outer chain 46 is imparted to chain dogs 172 and 174 through angled surfaces 202 and 204 which are at an angle relative to the direction of force 200, resulting in a wedging amplification of the force 200 yielding the sum of the resulting forces 206 and 208 being greater than the force 200. The forces 206 and 208 pass through chain dogs 172 and 174, respectively, and provide a frictional force against the umbilical 28. In like manner the forces are transmitted through umbilical 28 and load against chain dogs 210 and 212 yielding forces 214 and 216 against angled surfaces 218 and 220, down through inner chain 44 and onto harden track race 52 and track support 50 as reaction force 222 which equals force 200.

As load cylinder 70 is capable of putting up a force 200 which may not provide enough friction causing load to support the umbilical, the reaction force 222 effectively doubles the friction causing load available and the wedging action caused by angled surfaces 202, 204, 218, and 220 enhances force 200 and reaction force 222 to an even greater extent thereby providing sufficient frictional support to safely support the umbilical 28.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims.

That which is claimed is:

1. The method of supporting and lowering a subsea package load on an umbilical from a deck of an offshore service vessel to a subsea work location, comprising:

providing a reel to store said umbilical on the deck, said reel not capable of sustaining the maximum of said subsea package load, providing a tractor for supporting and lowering said subsea package load between said reel and said subsea package, said tractor providing a first (failsafe) force for loading against first chain blocks on a first chain in a first direction, said first chain blocks having 2 or more skewed surfaces at a first angle to said first direction, providing two first chain dogs mounted on said 2 or more first skewed surfaces on one side and engaging said umbilical on second surfaces, said second surfaces imparting a first and second normal friction load against said umbilical in second and third directions such that the sum of said first and said second normal friction forces applied to said umbilical is greater than said first force, said tractor providing second chain blocks on a second chain, said second chain blocks having 2 or more second skewed surfaces at a second angle to said first direction, providing two second chain dogs mounted on said 2 or more second skewed surfaces on one side and engaging said umbilical on a third surfaces, said third surfaces receiving a third and fourth normal friction forces from said umbilical in fourth and fifth directions such that the sum of said third and fourth normal friction forces received from said umbilical is greater than said first force, said third and fourth normal friction forces against said 2 or more second skewed surfaces combining to load said second chain blocks against a track with a sixth force proximately equaling and opposing said first force, and such that the sum of the normal frictional forces against said cable is greater than twice said first force.

2. The invention of claim 1 further comprising said first force is provided by one or more springs.

3. The invention of claim 1 further comprising said first force is provided by one or more hydraulic cylinders.

4. The invention of claim 1 further comprising said first chain blocks on said first chain are connected by first hinge pins with 2 or more rollers mounted on each first hinge pin.

5. The invention of claim 4 further comprising said first force is applied to said first chain blocks by applying said first force on said 2 or more first rollers.

6. The invention of claim 1 further comprising said second chain blocks of said second chain are connected by second hinge pins with two or more second rollers mounted on said second hinge pins.

7. The invention of claim 6 further comprising said two or more second rollers roll against said track.

8. The invention of claim 7 further comprising said track is a stationary track.

9. The invention of claim 8 further comprising said stationary track has a curved portion to translate said umbilical from proximately a vertical direction to proximately a horizontal direction.

10. The invention of claim 1 further comprising said umbilical comprises a steel outer tension layer.

11. The invention of claim 1 further comprising a remotely operated vehicle in said subsea package.

12. The invention of claim 1, further comprising said second and third surfaces are cylindrical and proximate the diameter of said umbilical.

* * * * *